US009854893B2

(12) United States Patent
Robinson

(10) Patent No.: US 9,854,893 B2
(45) Date of Patent: Jan. 2, 2018

(54) DEVICE FOR IMPROVING PERFORMANCE OF HAIR DRYER AND RELATED METHOD OF USE

(71) Applicant: Gina Robinson, Keosauqua, IA (US)

(72) Inventor: Gina Robinson, Keosauqua, IA (US)

(73) Assignee: HYRSAK, LLC, Keosauqua, IA (US)

( * ) Notice: Subject to any disclaimer, the term of this patent is extended or adjusted under 35 U.S.C. 154(b) by 0 days.

(21) Appl. No.: 15/177,023

(22) Filed: Jun. 8, 2016

(65) Prior Publication Data

US 2017/0156471 A1 Jun. 8, 2017

Related U.S. Application Data

(60) Provisional application No. 62/264,528, filed on Dec. 8, 2015.

(51) Int. Cl.
*A45D 20/12* (2006.01)

(52) U.S. Cl.
CPC ..... *A45D 20/12* (2013.01); *A45D 20/122* (2013.01)

(58) Field of Classification Search
CPC ..... A45D 20/12
USPC ..... 33/443, 96–100; 34/443, 96–100
See application file for complete search history.

(56) References Cited

U.S. PATENT DOCUMENTS 921,476 A * 5/1909 Soles ..... A45D 20/02 2/46
1,485,983 A * 3/1924 Hudson ..... A45D 20/44 132/212
1,504,149 A * 8/1924 Ruffio ..... A45D 20/44 34/99
1,543,423 A * 6/1925 Coune ..... A45D 20/18 132/212
1,637,488 A * 8/1927 Knopp ..... A45D 20/16 237/50
1,697,859 A * 1/1929 Forsberg ..... A45D 20/32 34/99
1,698,533 A * 1/1929 Brown ..... A45D 20/18 2/174
1,751,573 A * 3/1930 Bishinger ..... A45D 20/20 219/535
1,762,588 A * 6/1930 Rainey ..... A45D 20/44 132/212
1,765,380 A * 6/1930 McGinnis ..... A45D 20/26 34/99

(Continued)

FOREIGN PATENT DOCUMENTS

FR 2297015 A1 * 8/1976 ..... A45D 20/12
WO WO 8404649 A2 * 12/1984 ..... A45D 4/10

OTHER PUBLICATIONS

Conair, "Conair Soft Bonnet Hair Dryer," retrieved from http://www.amazon.com/conair-soft-bonnet-hair-dryer/dp/B0002G214U, last accessed Oct. 17, 2017, 7 pages.

(Continued)

*Primary Examiner* — Stephen M Gravini
(74) *Attorney, Agent, or Firm* — Nyemaster Goode P.C.

(57) ABSTRACT

This invention relates to a device, system and method for improving the performance and results of a hair dryer, and more particularly for increasing the efficiency and improving the time required to dry hair, in particular curly hair. The present invention results in hair with softer curls or waves that is easier to manage.

10 Claims, 8 Drawing Sheets

(56) References Cited

U.S. PATENT DOCUMENTS

| | | | | | |
|---|---|---|---|---|---|
| 1,773,083 | A * | 8/1930 | Troccoli | A45D 20/46 | 34/100 |
| 1,775,704 | A * | 9/1930 | Suter | A45D 20/44 | 126/204 |
| 1,784,139 | A * | 12/1930 | Gunter | A45D 20/26 | 132/212 |
| 2,263,418 | A * | 11/1941 | Ganim | A42B 1/041 | 2/174 |
| 3,044,183 | A | 7/1962 | Mauch et al. | | |
| 3,304,625 | A | 2/1967 | Gesmar et al. | | |
| 3,358,383 | A | 12/1967 | Snider | | |
| 3,383,700 | A | 5/1968 | Taylor | | |
| 3,727,321 | A | 4/1973 | Waters et al. | | |
| 3,818,600 | A | 6/1974 | Fischer | | |
| 3,822,483 | A | 7/1974 | Hubner | | |
| 3,946,498 | A | 3/1976 | Waters et al. | | |
| 4,038,759 | A | 8/1977 | Dyer et al. | | |
| 4,384,411 | A | 5/1983 | Stiegler et al. | | |
| 4,466,203 | A * | 8/1984 | Thomas | A45D 20/12 | 248/125.3 |
| 4,658,511 | A * | 4/1987 | Mahlich | A45D 20/18 | 34/101 |
| 4,692,594 | A | 9/1987 | Martin | | |
| 5,651,190 | A * | 7/1997 | Sanders | A45D 20/18 | 34/101 |
| 5,692,315 | A * | 12/1997 | Sham | A45D 19/16 | 34/99 |
| 5,829,157 | A * | 11/1998 | Gittens | A45D 20/20 | 34/99 |
| 6,049,994 | A * | 4/2000 | Pickett | A45D 20/42 | 34/96 |
| 6,052,915 | A * | 4/2000 | Turner | A45D 20/44 | 34/99 |
| 6,199,295 | B1 * | 3/2001 | Smal | A45D 20/122 | 34/98 |
| 6,301,800 | B1 | 10/2001 | Standley | | |
| 7,380,347 | B2 * | 6/2008 | Coats | A45D 20/12 | 34/97 |
| 7,946,056 | B2 * | 5/2011 | Kroll | A45D 20/22 | 132/233 |
| 8,701,306 | B2 * | 4/2014 | Hardwick | A45D 20/12 | 132/212 |
| 2012/0030858 | A1 * | 2/2012 | Duffin | A42B 3/0406 | 2/183 |
| 2017/0027262 | A1 * | 2/2017 | Palmer | A42B 1/12 | |
| 2017/0156471 | A1 * | 6/2017 | Robinson | A45D 20/12 | |

OTHER PUBLICATIONS

Vidal Sassoon, "Vidal Sassoon Hood Hair Dryer," retrieved from http://www.amazon.co.uk/Vidal-Sassoon-VSDR5815UK-Hood-Dryer/dp/B00E0GAGOK/ref=pd_sim_sbs_364_4?ie=UTF8&refRID=1A0GSY3WMSG0K%E2%80%A6, last accessed Oct. 17, 2017, 6 pages.

* cited by examiner

DEVICE FOR IMPROVING PERFORMANCE OF HAIR DRYER AND RELATED METHOD OF USE

RELATED PATENT APPLICATIONS

This application claims priority to provisional patent application Ser. No. 62/264,528 filed Dec. 8, 2015, which is incorporated by reference in its entirety.

This invention relates to a device, system and method for improving the performance and results of a hair dryer, and more particularly for increasing the efficiency and improving the time required to dry hair. According to one aspect of the present invention, the device can be used to advantageously dry hair, in particular curly hair. The present invention provides many benefits, including softer curls or waves. Another aspect of the present invention is a method for providing hair that is less frizzy and easier to manage.

BACKGROUND OF THE INVENTION

For decades, electric hair dryers have been used to dry and style hair. There have been modest improvements over time, including variations of the conventional hair dryer that have included caps, helmets, hoods or bonnets that can be worn on the head while drying the hair. For instance, early efforts are described in U.S. Pat. No. 3,304,625 to Black & Decker, describing a hair dryer connected by a plastic hose to a flexible hair drying bonnet, and U.S. Pat. No. 3,358,383 to Black & Decker, describing a hair dryer bonnet made of sheets of vinyl plastic. These hoods are undesirable and require a substantial amount of time to thoroughly dry the hair.

Further, drying curly hair has proven to be particularly difficult, where the heat from the hair dryer disproportionately flattens the hair and can lead to hair damage over time. Attachments to hair dryers, such as diffusers, have helped address this issue. However, there are several drawbacks to this approach, including the substantial length of time required to dry hair when using a diffuser attachment. Another problem is that the resulting hair is frizzy and may be difficult to manage and style. Accordingly, there remains a need for a device that can efficiently dry hair, in particular curly hair, which also results in softer curls or waves.

DETAILED DESCRIPTION OF THE INVENTION

Figure 1:
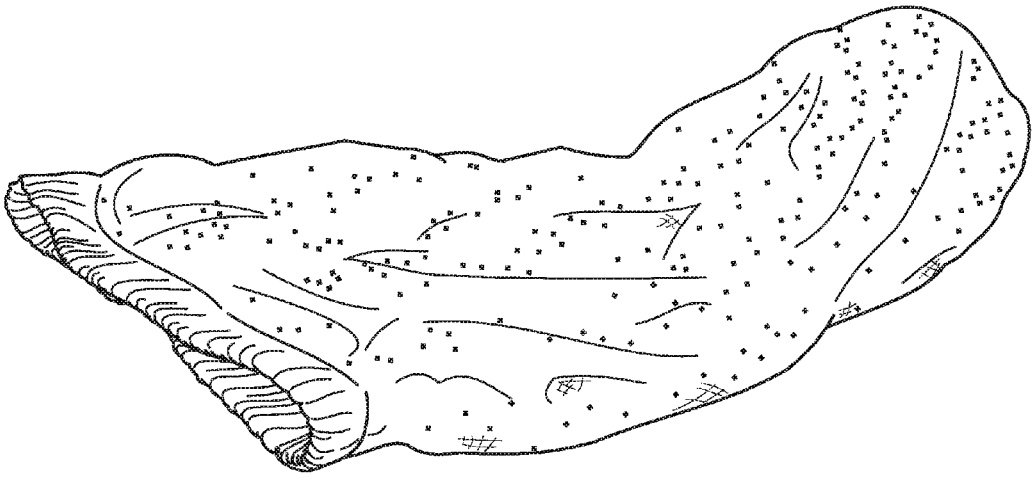
FIG. 1 depicts the hair dryer sleeve, prior to use.
Figure 2A:
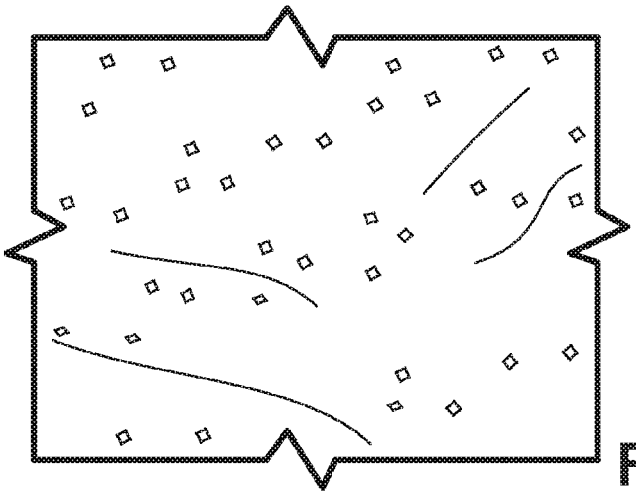
FIGS. 2A, 2B, and 2C depict the plurality of apertures on the sleeve body.
Figure 2B:
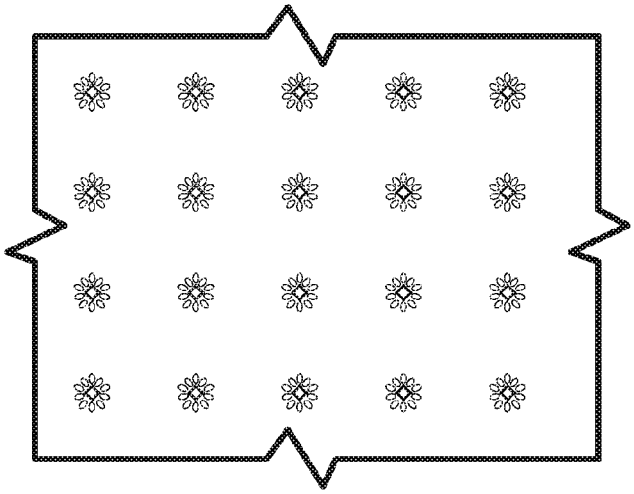
Figure 2C:
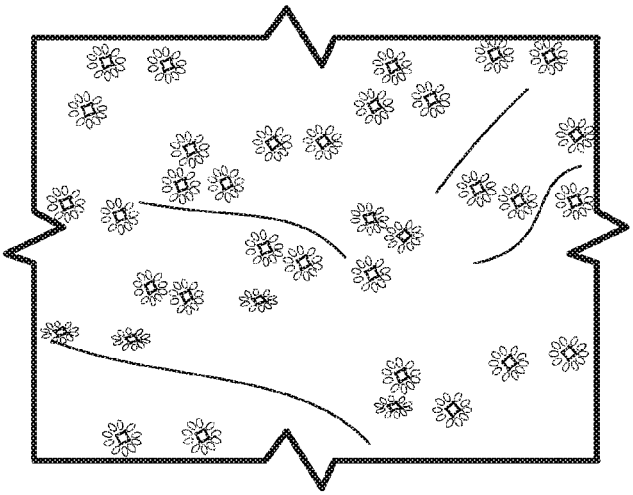
Figure 3:
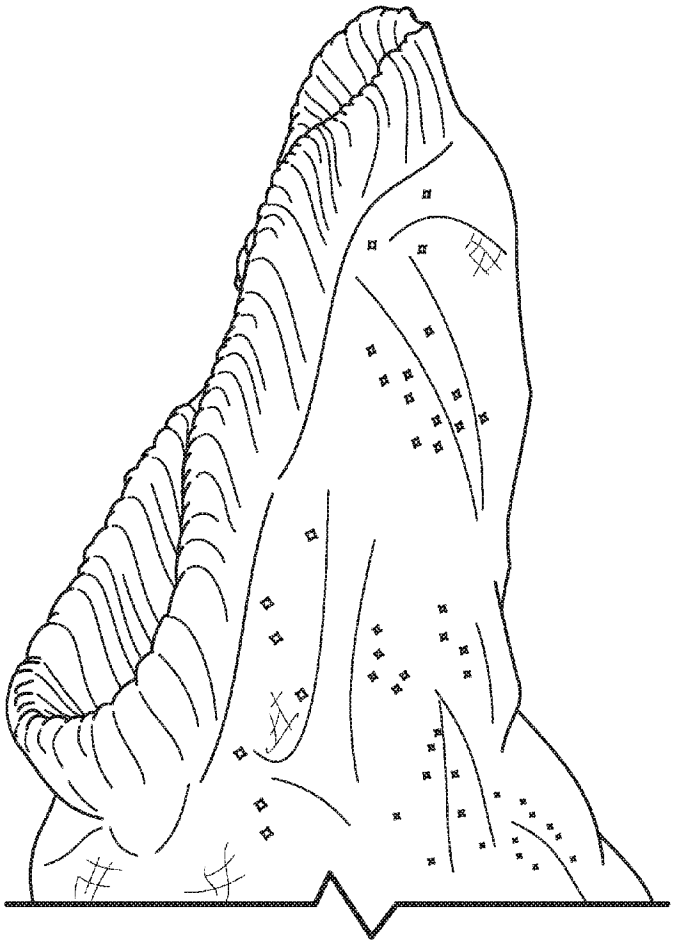
FIG. 3 depicts the second end of the hair dryer sleeve that is adapted to fit over the user's hair and receive the hair.
Figure 4:
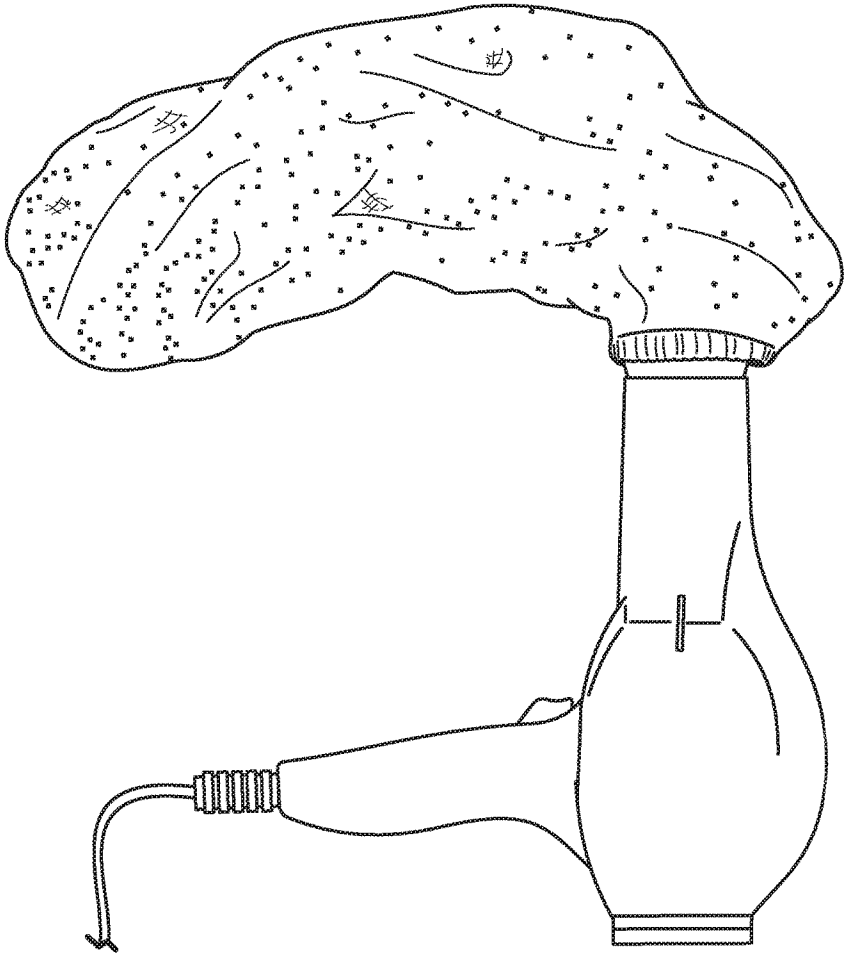
FIG. 4 depicts the first end of the hair dryer sleeve that is adapted to securely fit over the barrel or air source of the hair dryer.
Figure 5:
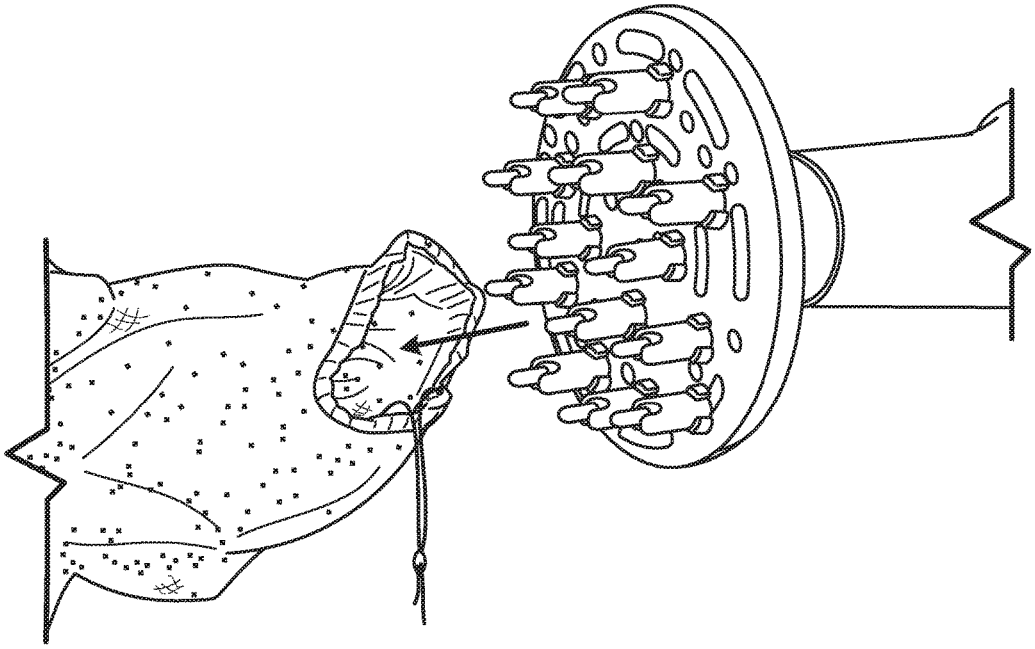
FIG. 5 depicts the barrel of the hair dryer, a diffuser, and the first end of the hair dryer sleeve with a drawstring.
Figure 6:
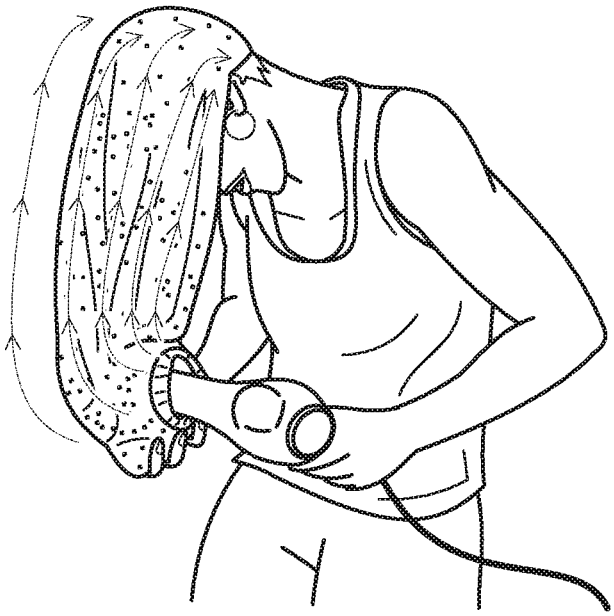
FIGS. 6 and 7 depict the use of the hair dryer sleeve.
Figure 7:
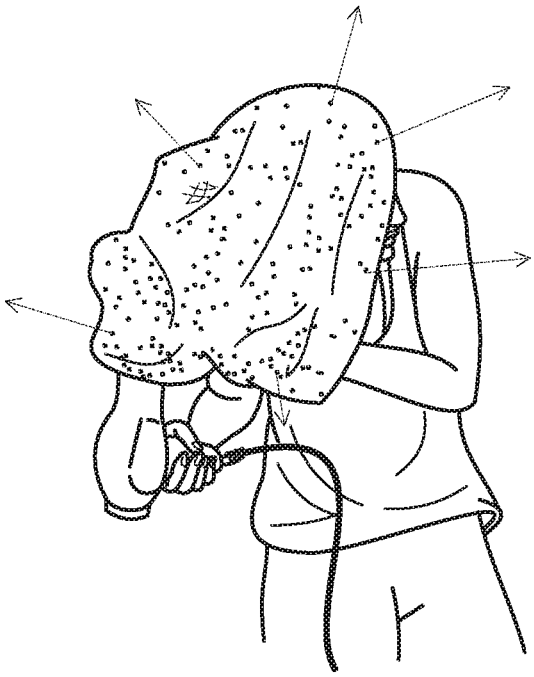
Figure 8:
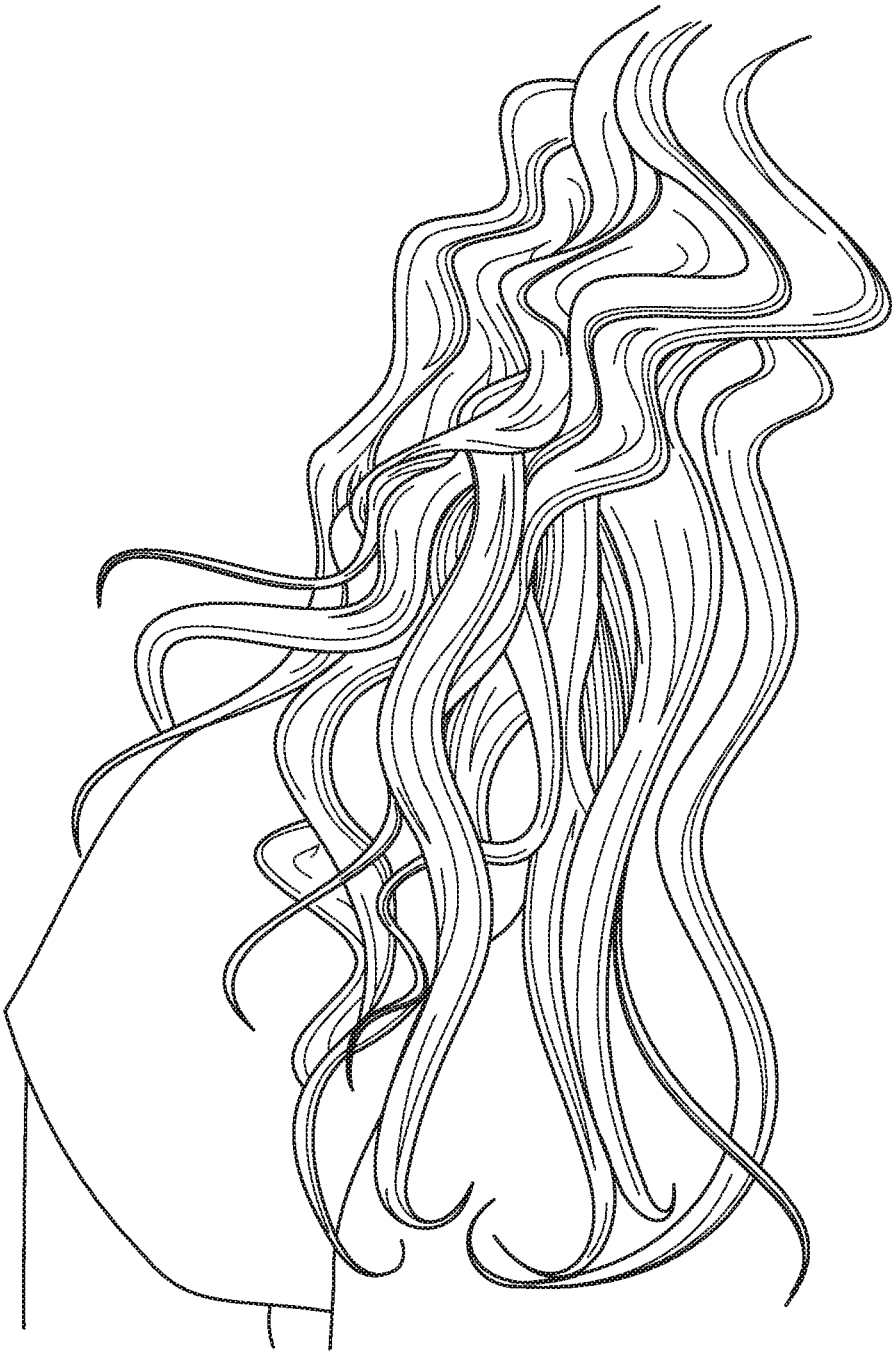
FIGS. 8 and 9 depict the resulting soft curls and waves achieved by the present invention.
Figure 9:
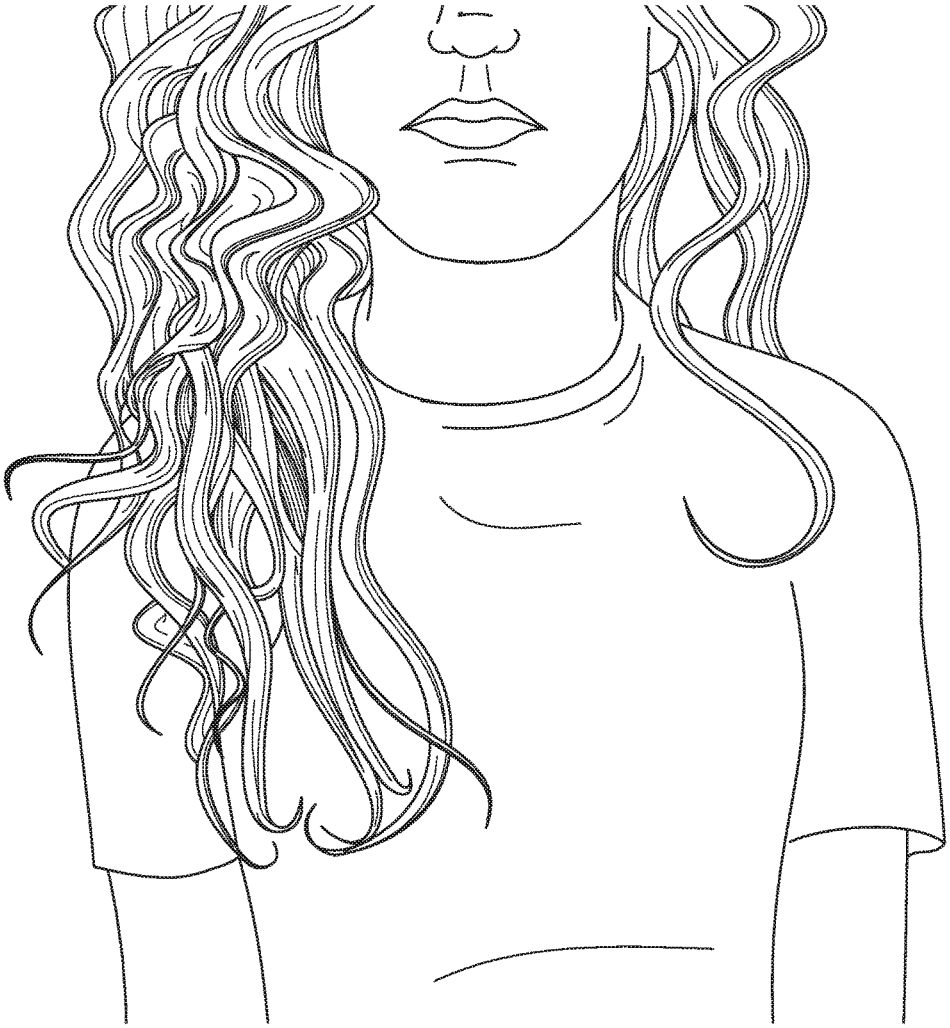

The present invention relates to a device, system and method for improving the performance and results of a hair dryer. More particularly, the present invention relates to increasing the efficiency and/or improving the time required to dry hair, particularly curly hair. One benefit of the invention is that it results in softer curls or waves. Another aspect of the present invention is a method for providing hair that is less frizzy and easier to manage.

In certain embodiments, the device comprises a tubular sleeve body 10, having a first end and a second end. The first end is adapted to fit securely over the barrel of a hair dryer. The sleeve body can be made of a variety of fabrics, and most preferably a fabric that will absorb moisture, including but not limited to cotton. In another embodiment, the sleeve body is made of a synthetic mesh fabric. In at least one embodiment, the sleeve body is made of a breathable fabric with additional holes for air ventilation. According to at least one embodiment, the sleeve body is made of a fabric that can absorb the water from the hair. In a further embodiment, the sleeve body is made of a fabric that can wick away the moisture from the hair.

In certain embodiments, the first end is secured to a diffuser that is positioned or optionally attached to the end of a hair dryer barrel. The sleeve body second end is adapted to fit over the head of the user such that the hair of user is enclosed within the body of the sleeve. The sleeve body is fashioned from a moisture absorbent material such as fabric or synthetic mesh. The sleeve body further comprises a plurality of ringlets or apertures arranged along the length of the sleeve. In certain embodiments, the first and second ends are conformable around hair dryer diffuser and the head/neck of the user, respectively. In certain implementations, the first and second ends comprise an elastic ring. In further implementations the first and second end comprise drawstrings.

In use, the user secures the first end of the sleeve body to the hair dryer diffuser and pulls the second end of the sleeve over the user's head such that the user's hair in contained within the sleeve body. The user then turns on the hair dryer which channels air over the hair of the user. While it is being used, the user may optionally manipulate the hair through the sleeve body to promote absorption of the water by the sleeve body and to increase the surface area of the hair exposed to moving air.

In certain embodiments, the user may wrap the hair in rollers or curlers, for instance including but not limited to self-gripping rollers, velcro cling rollers, foam rollers, or soft curlers, in order to provide additional volume and styling of the hair.

In certain embodiments, the sleeve body contains an opening, preferably configured to permit the user to reach in and feel the hair, or alternatively scrunch the hair during operation. The opening also allows the user to determine whether the hair is completely dry prior to removing the hair from the sleeve body.

EXAMPLE 1

The inventor tested the amount of time required to dry long, curly hair. Starting with wet hair, and using a hair dryer with a diffuser attachment, the hair was dried in 12-13 minutes. The same test was performed with the hair dryer sleeve. When the hair dryer sleeve was used, the hair was dried in approximately 4-5 minutes.

TABLE 1

| Comparison of Drying Methods | |
|---|---|
| Drying Method | Time Required to Dry Hair |
| Hair Dryer, with Diffuser | 12-13 minutes |
| Hair Dryer, with Diffuser and Sleeve | 4-5 minutes |

EXAMPLE 2

Further, the inventor compared the characteristics and texture of the hair after various drying methods. When compared against the hair dryer with the diffuser without the sleeve, the hair dried with the diffuser and the hair dryer sleeve, the resulting hair had softer curls and had a less frizzy texture.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art who have the disclosure before them will be able to make modifications and variations therein without departing from the scope of the invention.

I claim:

1. An apparatus for drying hair that attaches to a hair dryer, wherein the hair dryer sleeve comprises:

a. at least one tubular sleeve body, having a first end and a second end, wherein the first end is adapted to fit securely over the air source of a hair dryer, and the second end is adapted to receive the hair; and b. a plurality of apertures, wherein the apertures are arranged along the length of the tubular sleeve body.

2. The apparatus of claim 1, wherein the sleeve is made of natural or synthetic material.

3. The apparatus of claim 1, wherein the sleeve is made of a fabric that can absorb water.

4. The apparatus of claim 3, wherein the fabric is cotton.

5. The apparatus of claim 1, wherein the hair dryer sleeve further comprises an opening.

6. The apparatus of claim 1, wherein at least one of the first end and/or the second end contain elastic or a drawstring.

7. A method for drying hair comprising a. using a hair dryer sleeve, wherein the hair dryer sleeve comprises:

i. at least one tubular sleeve body, having a first end and a second end, wherein the first end is adapted to fit securely over the air source of a hair dryer, and the second end is adapted to receive the hair; and ii. a plurality of apertures, wherein the apertures are arranged along the length of the tubular sleeve body;

b. connecting the sleeve to a hair dryer; and c. drying for until the hair is dry.

8. The method of claim 7 wherein the amount of time required to dry the hair is less than the amount of time required to dry the hair without the hair dryer sleeve.

9. The method of claim 7 wherein the hair is wrapped in curlers before using the hair dryer sleeve.

10. The method of claim 8, wherein using the hair dryer sleeve results in soft curls or waves.

* * * * *